US010199777B2

(12) United States Patent
Zhao

(10) Patent No.: US 10,199,777 B2
(45) Date of Patent: Feb. 5, 2019

(54) ELECTRICAL CONNECTOR HAVING A MIDDLE SHIELDING PLATE AVOIDING A POWER CONTACT

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/790,087

(22) Filed: Oct. 23, 2017

(65) Prior Publication Data

US 2018/0115118 A1 Apr. 26, 2018

(30) Foreign Application Priority Data

Oct. 21, 2016 (CN) ..... 2016 1 0918697

(51) Int. Cl.

| | |
|---|---|
| ***H01R 13/6585*** | (2011.01) |
| *H01R 13/6591* | (2011.01) |
| *H01R 24/60* | (2011.01) |
| *H01R 107/00* | (2006.01) |

(52) U.S. Cl.

CPC ..... *H01R 13/6585* (2013.01); *H01R 13/6591* (2013.01); *H01R 24/60* (2013.01); *H01R 2107/00* (2013.01)

(58) Field of Classification Search

CPC . H01R 13/6585; H01R 13/6591; H01R 24/60
USPC ..... 439/607.05
See application file for complete search history.

(56) References Cited

U.S. PATENT DOCUMENTS

| | | | | |
|---|---|---|---|---|
| 8,684,769 | B2 * | 4/2014 | Kao | H01R 13/6471 439/607.28 |
| 9,281,643 | B1 * | 3/2016 | Tseng | H01R 13/518 |
| 9,300,095 | B2 * | 3/2016 | Lin | H01R 24/60 |
| 9,450,337 | B2 * | 9/2016 | Kao | H01R 13/6461 |
| 9,490,595 | B2 * | 11/2016 | Little | H01R 13/6594 |
| 9,502,821 | B2 * | 11/2016 | Little | H01R 13/6582 |
| 9,590,360 | B2 * | 3/2017 | Chuang | H01R 13/6581 |
| 9,595,796 | B2 * | 3/2017 | Yen | H01R 13/6581 |
| 9,647,369 | B2 * | 5/2017 | Tsai | H01R 4/02 |
| 9,917,405 | B2 * | 3/2018 | Ju | H01R 13/6585 |
| 9,948,046 | B1 * | 4/2018 | Peng | H01R 27/02 |

FOREIGN PATENT DOCUMENTS

| | | |
|---|---|---|
| CN | 105490059 | 4/2016 |

* cited by examiner

*Primary Examiner* — Alexander Gilman
(74) *Attorney, Agent, or Firm* — Wei Te Chung; Ming Chieh Chang

(57) ABSTRACT

An electrical connector includes: an insulative housing having a base and a tongue; an upper and lower rows of contacts mounted in the insulative housing and exposed to the tongue, the upper and lower rows of contacts including at least one power contact; a shielding shell (4) enclosing the insulative housing; and a shielding plate (3) mounted in the insulative housing and shielded between the upper row of contacts and the lower row of contacts; wherein the shielding plate has a center portion (33), a pair of opposite side portions (34) integrally connected with the center portion, and a pair of slits (321) between the center portion and the side portions; and the slit is aligned with the at least one power contact.

17 Claims, 8 Drawing Sheets

ELECTRICAL CONNECTOR HAVING A MIDDLE SHIELDING PLATE AVOIDING A POWER CONTACT

BACKGROUND OF THE INVENTION

1. Field of the Invention

The present invention relates to an electrical connector having an upper and lower rows of contacts and a middle shielding plate shielded between the upper row of contacts and the lower row of contacts, wherein the shielding plate has a void space so as not to directly confronting a power contact thereof.

2. Description of Related Art

China Patent No. 105490059 discloses an electrical connector comprising an insulative housing, an upper and lower rows of contacts, a shielding shell enclosing the insulative housing, and a shielding plate between the upper row of contacts and the lower row of contacts, wherein the shielding plate has a pair of opposite side portions and a void space therebetween. Each row of contacts include in sequence, or in reverse sequence, one ground contact, one power contact, three signal and/or control contacts, one power contact, and one ground contact. The power and signal/control contacts are aligned with the void space while the ground contacts are aligned with the shielding plate side portions. This arrangement avoids potential shorting problem between the power contact and the shielding plate, especially when the power contact is thickened in certain applications.

SUMMARY OF THE INVENTION

An electrical connector comprises: an insulative housing having a base and a tongue; an upper and lower rows of contacts mounted in the insulative housing and exposed to the tongue, the upper and lower rows of contacts including at least one power contact; a shielding shell enclosing the insulative housing; and a shielding plate mounted in the insulative housing and shielded between the upper row of contacts and the lower row of contacts; wherein the shielding plate has a center portion, a pair of opposite side portions integrally connected with the center portion, and a pair of slits between the center portion and the side portions; and the slit is aligned with the at least one power contact.

DETAILED DESCRIPTION OF THE PREFERRED EMBODIMENT

Figure 1:
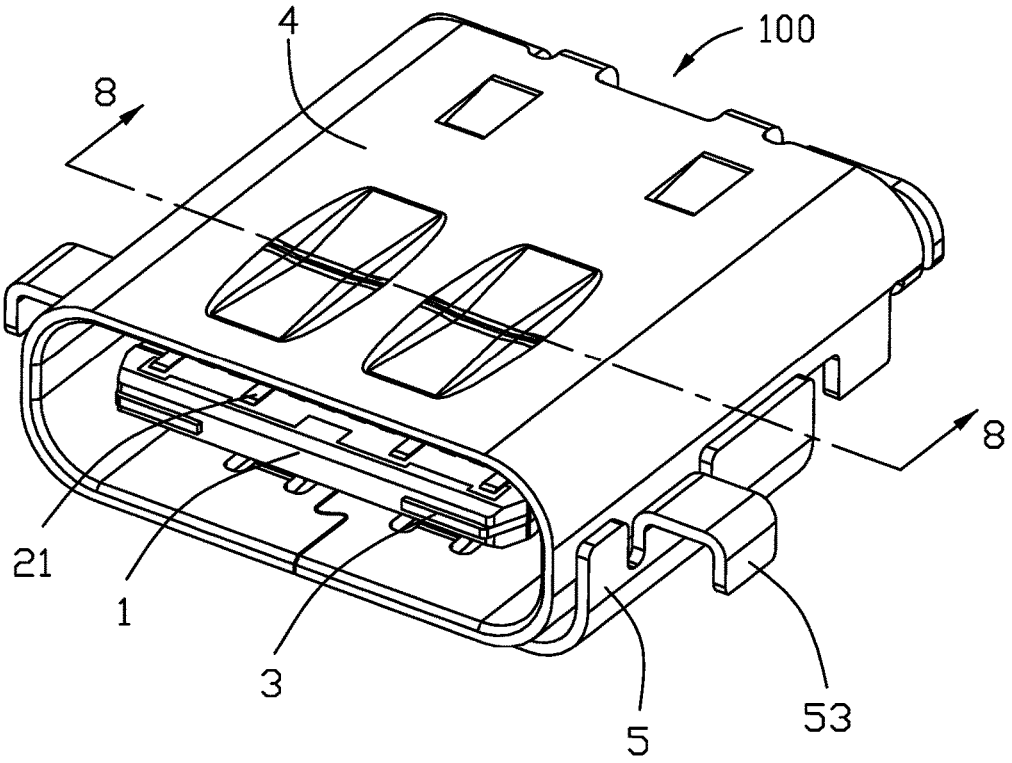
FIG. 1 is a perspective view of an electrical connector in accordance with the present invention.
Figure 2:
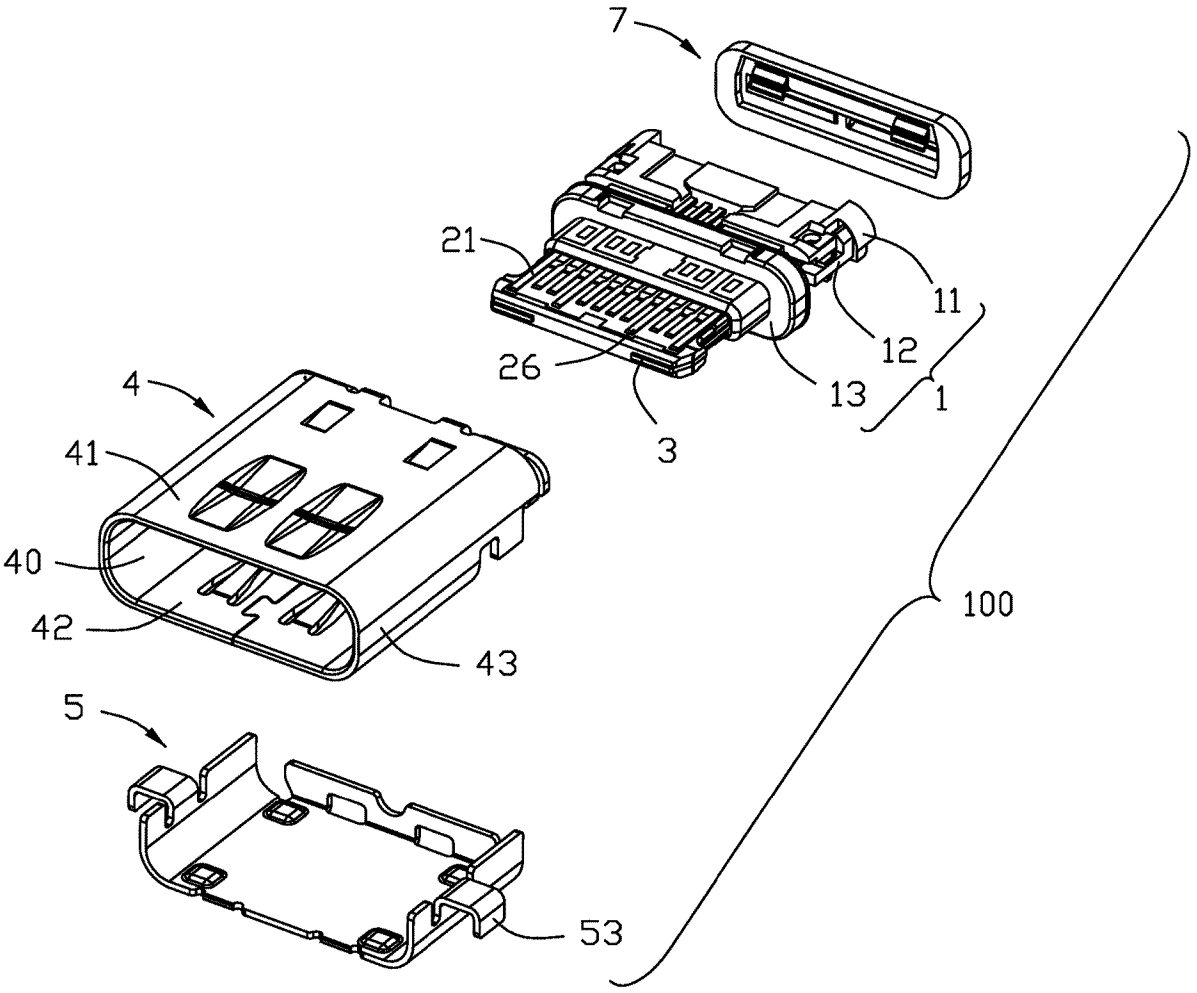
FIG. 2 is an exploded view of the electrical connector.

Referring to FIGS. 1-5, an electrical connector 100 comprises an insulative housing 1, an upper and lower rows of contacts 21 and 22 mounted to the insulative housing 1, a shielding plate 3 mounted in the insulative housing and shielded between the upper row of contacts 21 and the lower row of contacts 22, and a shielding shell 4 enclosing the insulative housing 1. The electrical connector 100 may further comprise a metal shell 5 covering a bottom of the shielding shell 4 and a sealing member 7 at a rear of the insulative housing 1.

Figure 3:
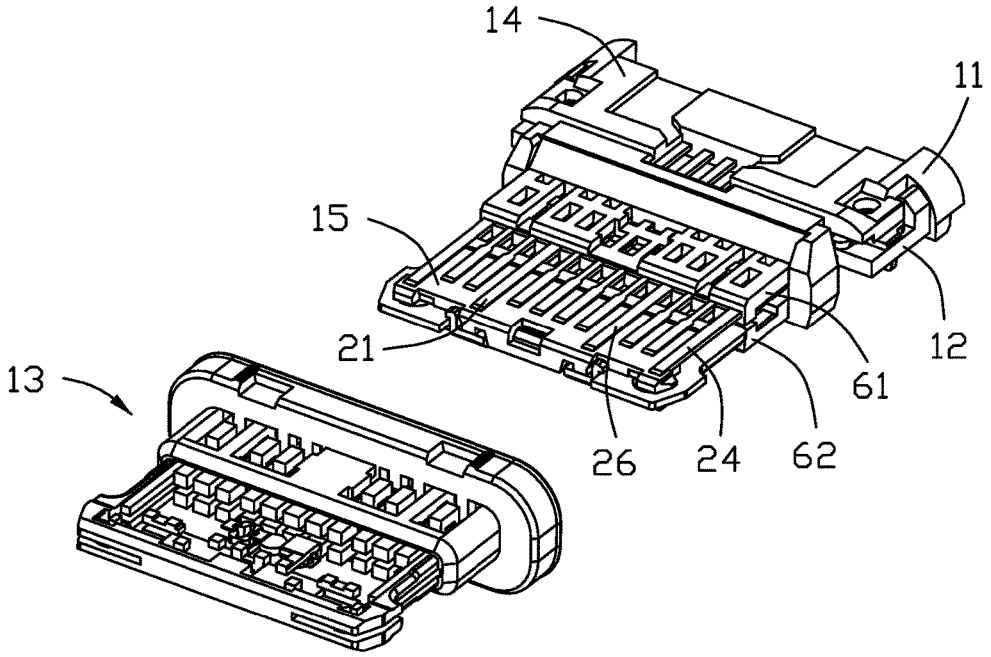
FIG. 3 is an exploded view of an insulative housing, an upper and lower rows of contacts, and a shielding plate of the electrical connector.
Figure 4:
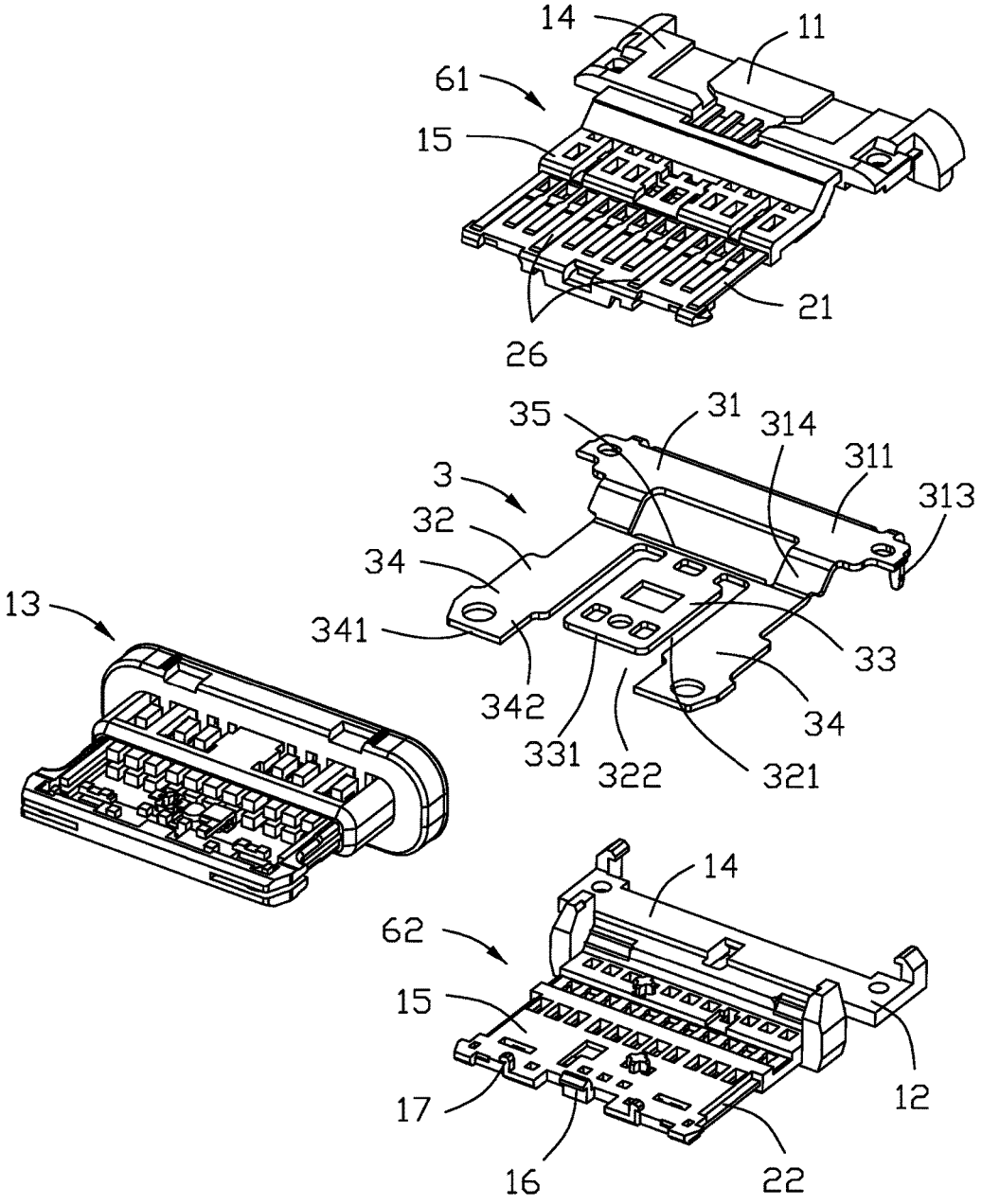
FIG. 4 is a further exploded view of FIG. 3.
Figure 5:
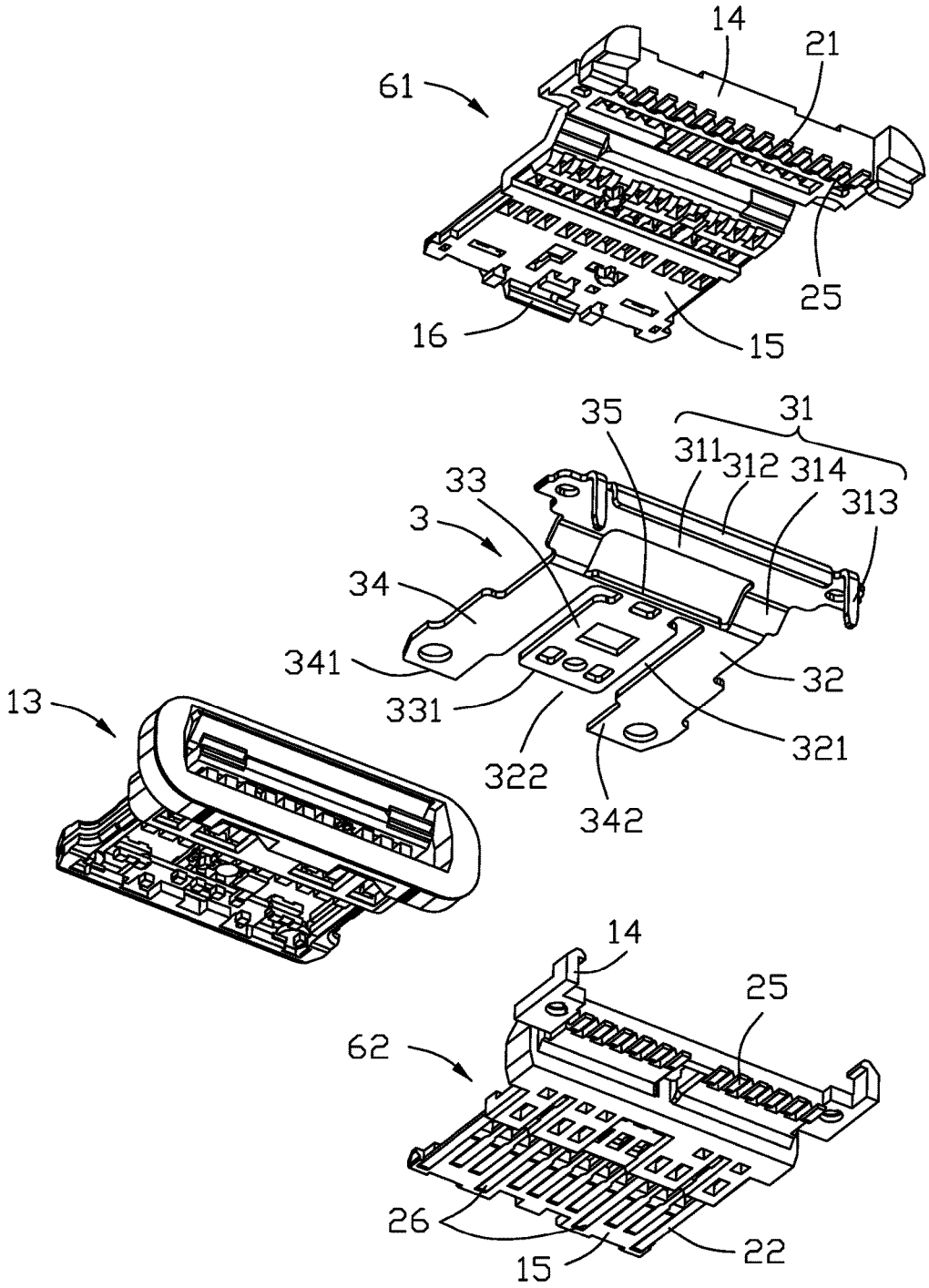
FIG. 5 is a view similar to FIG. 4 but from a different perspective.

Referring specifically to FIGS. 3-5, the insulative housing 1 includes a first body 11 receiving the upper row of contacts 21, a second body 12 receiving the lower row of contacts 22, and a third body 13 molding the first and second bodies 11 and 12. Each of the first and second bodies 11 and 12 has a base 14 and a tongue 15. Each of the contacts 21 and 22 has a contacting portion/section 24 exposed upon the corresponding surface of the tongue 15 and a tail 25 extending out of the base 14. Each of the first and second bodies 11 and 12 further has a latch 16. The body 12 further has a pair of clips 17 for latching onto the shielding plate 3. In brief, the housing essentially includes a base and a tongue extending forwardly from the base in the front-to-back direction wherein the tongue forms opposite surfaces in the vertical direction perpendicular to the front-to-back direction.

Figure 6:
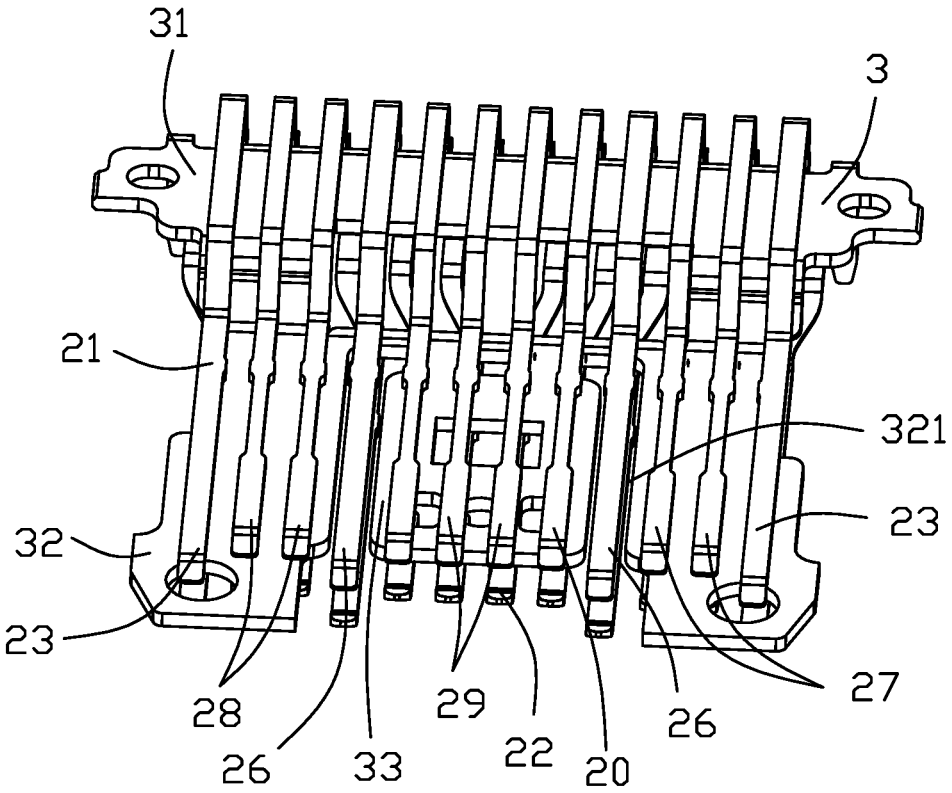
FIG. 6 is a perspective view of the upper and lower rows of contacts and the shielding plate.
Figure 7:
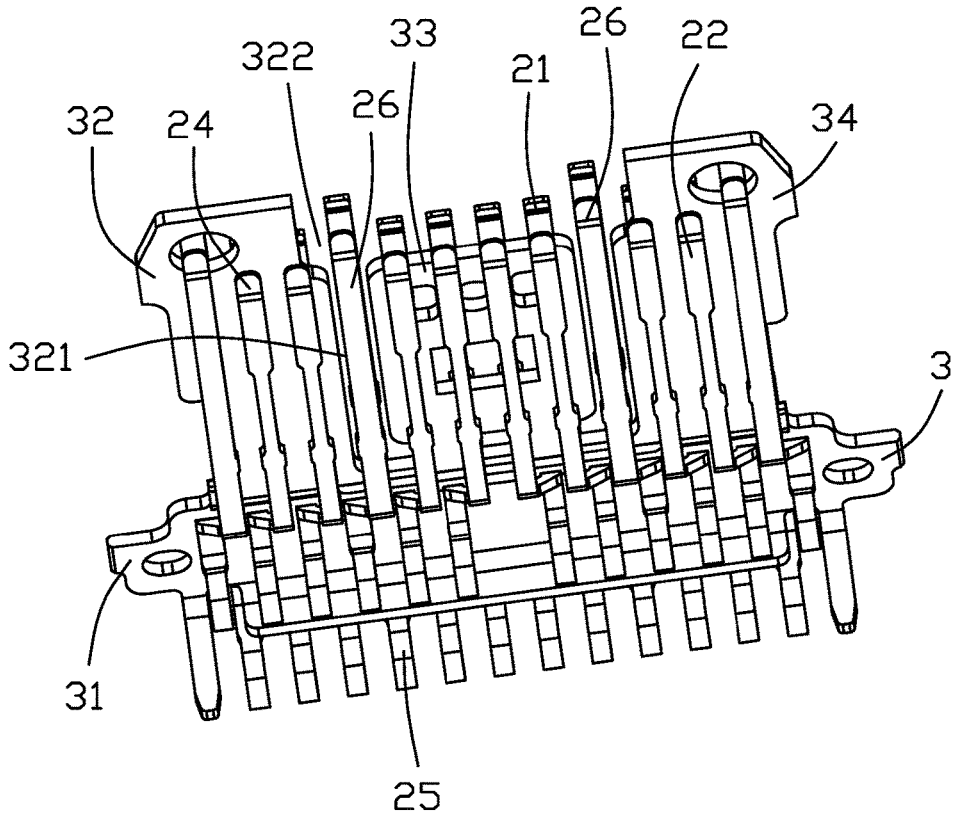
FIG. 7 is a view similar to FIG. 6 but from a different perspective.
Figure 8:
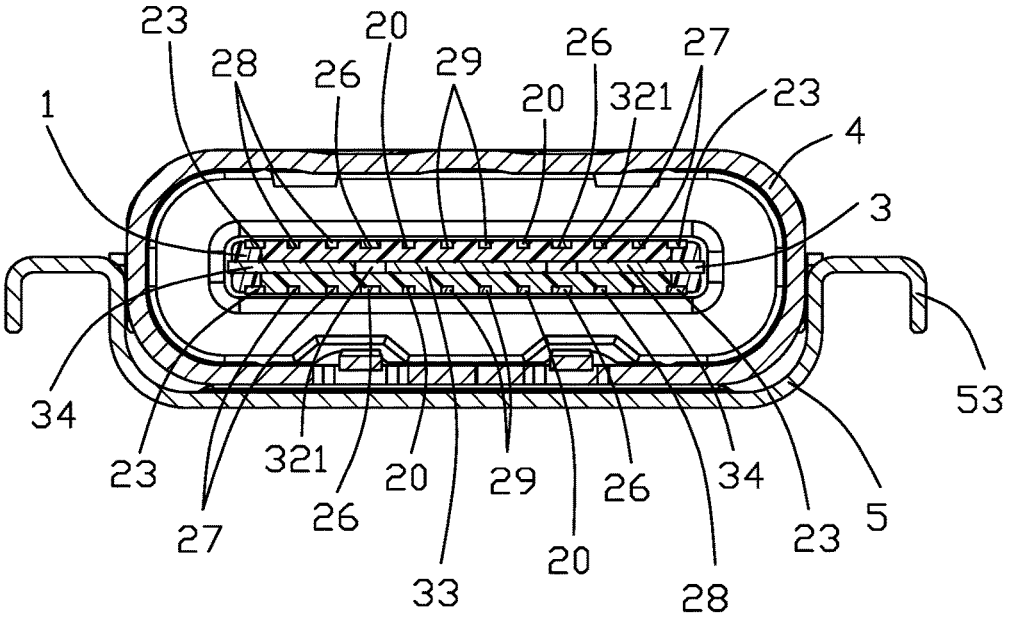
FIG. 8 is a cross-sectional view of the electrical connector taken along line A-A in FIG. 1.

Referring to FIGS. 6-8, the upper row of contacts 21 and the lower row of contacts 22 are aligned in an up-and-down direction and are reversely symmetrical, each row including two ground contacts 23, a pair of low speed differential signal contacts 29, a pair of reserved contacts 20 on two sides of the contacts 29, two power contacts 26, a pair of transmit differential signal contacts 28, and a pair of receive differential signal contacts 27. All the contacts are arranged with one another along the transverse direction perpendicular to both the front-to-back direction and the vertical direction.

The upper row of contacts 21 and the first body 11 may be insert molded to form a first terminal module 61; the lower row of contacts 22 and the second body 12 may be insert molded to form a second terminal module 62. The shielding plate 3 is clamped between the first and second terminal modules 61 and 62. The third body 13 is then over molded to the combination of the first and second terminal modules 61 and 62 and the shielding plate 3. In place of molding, other ways of assembling are contemplated.

Referring to FIGS. 4-8, the shielding plate 3 is metallic and has a base portion 31, a tongue portion 32, and a connecting portion 35. The tongue portion 32 has a center portion 33, a pair of opposite side portions 34 integrally connected with the center portion 33 by the connecting portion 35, and a pair of slits 321 between the center portion 33 and the side portions 34, respectively. The slit 321 opens to a front of the shielding plate 3. The connecting portion 35 may alternatively be formed as part of the tongue portion 32 or part of the base portion 31. A length of the side portion 34 along a front-and-back direction is greater than a length of the center portion 33 so that a front 331 of the center portion 33 is recessed rearward with respect to a front 341 of the side portion 34 to leave a void space 322 for accommodating the latches 16. The void space 322 is in fluid communication with the slits 321 and cooperates with the pair of slits 321 to commonly form a U-shaped opening. In this embodiment, the void space is filled with the material of the third body 13 while the pair of slits are not. Understandably, alternately the slits 321 also may be filled with the third body 13 if either the first body 11 or the second body 12 forms a corresponding interior channel communicatively aligned with the slit 321 for guiding the material of the third body 13 into the slit 321. The side portion 34 has a front inner edge 342 for engaging the clip 17. Alternatively, the connecting portion 35 may be designed to connect different portions of the center portion 33 and the side portions 34. For example, the connecting portion 35 may connect the front of the center portion 33 to respective fronts of the side portions 34.

Referring specifically to FIGS. 4-5, the base portion 31 includes a plate 311 clamped between the first and second bodies 11 and 12, a pair of transitions 314 connecting to the tongue portion 32, a flap 312 bent from the plate 311 to be situated between the row of tails of the contacts 21 and the tails of the contacts 22, and a pair of legs 313 bent downwardly from the plate 311. Notably, in this embodiment an opening (not labeled) is formed between the transitions 314 in the transverse direction while that opening is isolated from the pair of slits 321 in the front-to-back direction so as to assure no material of the third body 13 may invade the slits 321 via that opening.

Referring again to FIGS. 6-8, the power contacts 26 of the upper row of contacts 21 and the power contacts 26 of the lower row of contacts 22 are aligned so that the contacting portions 24 of the power contacts 26 are aligned with the slits 321, respectively. A length of the slit 321 is no less than a length of the contacting portion 24 of the power contact 26 and a width of the lit 321 is greater than a width of the contacting portion 24 of the power contact 26. Preferably, the length of the slit 321 is no less than a length of the tongue 15. The center portion 33 and the side portions 34 are aligned in the up-and-down direction with the contacting portions of all of the contacts except for the power contacts 26 to have a better shielding effect. Alignment of the power contacts with the slits prevents potential risk of shorting. On the other hand, the slit 321 is also be narrow enough in the transverse direction for not jeopardizing the original shielding effect in there vertical direction between the differential signal contacts of the upper row contacts and those of the lower row contacts all of which are neighboring the power contacts in the transverse direction.

Referring back to FIGS. 1-2, the shielding shell 4 includes a top wall 41, a bottom wall 42, and a pair of side walls 43 to define a receiving space 40. The metal shell 5 is mounted to the bottom wall 42 of the shielding shell 4 and has a pair of mounting legs 53 at two opposite sides thereof.

What is claimed is:

1. An electrical connector comprising:

an insulative housing having a base and a tongue;

an upper and lower rows of contacts mounted in the insulative housing and exposed to the tongue, the upper and lower rows of contacts including at least one power contact;

a shielding shell enclosing the insulative housing; and a shielding plate mounted in the insulative housing and shielded between the upper row of contacts and the lower row of contacts; wherein the shielding plate has a center portion, a pair of opposite side portions integrally connected with the center portion, and a pair of slits between the center portion and the side portions; and the slit is aligned with the at least one power contact and has a length greater than a length of the tongue.

2. The electrical connector as claimed in claim 1, wherein the slit opens to a front of the shielding plate.

3. An electrical connector comprising:

an insulative housing having a base and a tongue extending forwardly from the base in a front-to-back direction, the tongue defining opposite first and second surfaces in a vertical direction perpendicular to said front-to-back direction;

a plurality of first contacts disposed in the housing with corresponding first contacting sections exposed upon the first surface and arranged with one another along a transverse direction perpendicular to both said front-to-back direction and said vertical direction, the first contacts including a pair of first grounding contacts at two opposite sides and a pair of first power contacts between said pair of first grounding contacts in the transverse direction;

a plurality of second contacts disposed in the housing with corresponding second contacting sections exposed upon the second surface of the tongue and arranged with one another along the transverse direction, the second contacts including a pair of second grounding contacts at two opposite sides and a pair of second power contacts between said pair of second grounding contacts in the transverse direction, the first grounding contacts being aligned with the corresponding second grounding contacts respectively in the vertical direction, and the first power contacts being aligned with the corresponding second power contacts in the vertical direction respectively; and a metallic shielding plate located between the first contacts and the second contacts in the vertical direction; wherein the shielding plate forms a U-shaped opening essentially composed of a pair of slits and a void in fluid communication with each other, said void is filled with material of the housing and each of the slits is aligned with both the corresponding first power contact and the corresponding second power contact in the vertical direction; and said shielding plate includes a tongue portion embedded within the tongue of the housing, the U-shaped opening is formed in the tongue portion, and said shielding plate further includes a pair of transitions extending rearwardly and obliquely from a rear edge of the tongue portion with an opening therebetween in the transverse direction.

4. The electrical connector as claimed in claim 3, wherein a width of the slit is slightly larger than those of the corresponding first power contact and second power contact.

5. The electrical connector as claimed in claim 3, wherein said slit is empty without the material of the housing filled therein.

6. The electrical connector as claimed in claim 3, wherein said U-shaped opening forwardly communicates with an exterior in the front-to-back direction.

7. The electrical connector as claimed in claim 3, wherein said shielding plate includes a center portion between the pair of slits in the transverse direction.

8. The electrical connector as claimed in claim 7, wherein said shielding plate further includes a pair of side portions respectively located by two sides of the pair of slits.

9. The electrical connector as claimed in claim 8, wherein said pair of side portions extend forwardly beyond the center portion so as to form the void therebetween in the transverse direction.

10. The electrical connector as claimed in claim 7, wherein said center portion forms a plurality of through holes in the vertical direction, said through holes are isolated from the slits in the transverse direction.

11. The electrical connector as claimed in claim 3, wherein the opening between the pair of transitions in the transverse direction, is isolated from the pair of slits in the front-to-back direction so as to assure no material of the housing invades the slits via said opening.

12. The electrical connector as claimed in claim 3, wherein in said first contacts, a pair of first lower speed differential signal contacts and a pair of first high speed differential signal contacts are respectively located by two sides of each of said first power contacts in the transverse direction, and in said second contacts, a pair of second lower speed differential signal contacts and a pair of second high speed differential signal contacts are respectively located by two sides of each of said second power contacts in the transverse direction.

13. An electrical connector comprising:

an insulative housing having a base and a tongue extending forwardly from the base in a front-to-back direction, the tongue defining opposite first and second surfaces in a vertical direction perpendicular to said front-to-back direction;

a plurality of first contacts disposed in the housing with corresponding first contacting sections exposed upon the first surface and arranged with one another along a transverse direction perpendicular to both said front-to-back direction and said vertical direction, the first contacts including a pair of first grounding contacts at two opposite sides and a pair of first power contacts between said pair of first grounding contacts in the transverse direction;

a plurality of second contacts disposed in the housing with corresponding second contacting sections exposed upon the second surface of the tongue and arranged with one another along the transverse direction, the second contacts including a pair of second grounding contacts at two opposite sides and a pair of second power contacts between said pair of second grounding contacts in the transverse direction, the first grounding contacts being aligned with the corresponding second grounding contacts respectively in the vertical direction, and the first power contacts being aligned with the corresponding second power contacts in the vertical direction respectively; and a metallic shielding plate located between the first contacts and the second contacts in the vertical direction; wherein the shielding plate defines a pair of slits forwardly extending through a front edge of the shielding plate along the front-to-back direction, each of said slits is aligned with the corresponding first power contact and second power contact in the vertical direction, and is dimensioned with a width, in the transverse direction, which is small enough not to be aligned, in the vertical direction, with other first contacts neighboring the corresponding first power contact or with other second contacts neighboring the corresponding second power contacts for assuring shielding effect between said other first contacts and said other second contacts in the vertical direction; and each slit has a length greater than a length of the tongue.

14. The electrical connector as claimed in claim 13, wherein said shielding plate includes a center portion and two side portions with said pair of slits therebetween in the transverse direction.

15. The electrical connector as claimed in claim 14, wherein a void is formed in front of the center portion in fluid communication with the slits, said void is filled with material of the housing.

16. The electrical connector as claimed in claim 15, wherein said slits are not empty without the material of the housing filled therein.

17. The electrical connector as claimed in claim 13, wherein said pair of side portions extends forwardly beyond said center portion in the front-to-back direction.

* * * * *